United States Patent [19]

Sawyer, Sr. et al.

[11] Patent Number: 4,697,728

[45] Date of Patent: Oct. 6, 1987

[54] PAPER WEB SPREADING SHOE

[76] Inventors: William D. Sawyer, Sr., 1512 Elizabeth; William D. Sawyer, Jr., 1511 N. 7th St., both of West Monroe, La. 71291

[21] Appl. No.: 819,343

[22] Filed: Jan. 16, 1986

[51] Int. Cl.[4] ..... B65H 23/10; B65H 23/34; D06C 3/00

[52] U.S. Cl. ..... 226/196; 26/87; 162/271; 226/88

[58] Field of Search ..... 276/88, 192, 197, 196, 276/190, 193, 200; 162/361, 352, 271, 283; 26/87, 99

[56] References Cited

U.S. PATENT DOCUMENTS

| | | | |
|---|---|---|---|
| 1,194,348 | 8/1916 | Barber | 162/271 |
| 2,285,487 | 6/1942 | Batie | 75/37 |
| 3,744,693 | 7/1973 | Greiner | 226/196 X |
| 4,035,878 | 7/1977 | Cheatham | 226/196 X |
| 4,176,775 | 12/1979 | Brendemuehl | 226/197 X |
| 4,223,426 | 9/1980 | Demiere | 162/271 X |

*Primary Examiner*—Stuart S. Levy
*Assistant Examiner*—Lynn M. Sohacki
*Attorney, Agent, or Firm*—Harvey B. Jacobson

[57] ABSTRACT

A spreader bar shoe mounted on the spreader bar of a paper making machine to smooth the sheet or web of paper prior to it being wound onto the takeup reel at the end of the paper machine. The spreader shoe is in the form of an elongated base of plastic material mounted on the spreader bar with segmental inserts forming a wear resistant strip in the outer surface of the base for engagement by the paper sheet with the segmental inserts being secured in a recess by a resilient interface material in the form of silicone to permit limited relative movement between the brittle insert segments and the plastic base due to differences in thermal expansion of the dissimilar materials of the brittle ceramic inserts and the plastic base.

7 Claims, 6 Drawing Figures

PAPER WEB SPREADING SHOE

BACKGROUND OF THE INVENTION

Field of the Invention

The present invention generally relates to a spreader bar shoe mounted on the spreader bar of a paper making machine to smooth the sheet or web of paper prior to it being wound onto the takeup reel at the end of the paper machine. The spreader shoe is in the form of an elongated base of plastic material mounted on the spreader bar with segmental inserts in the outer surface of the base for engagement by the paper sheet with the segmental inserts being secured in a recess by a resilient interface material in the form of silicone to permit limited relative movement between the brittle inserts and the plastic base due to differences in thermal expansion of the dissimilar materials of the brittle ceramic inserts and the plastic base.

SUMMARY OF THE INVENTION

An object of the present invention if to provide a spreader shoe used on a paper machine in order to smooth the sheet or web of paper produced by the paper machine prior to it being wound onto the takeup reel at the end of the machine in which the shoe is secured to an existing spreader bar in the form of a tubular pipe or the like and which includes an insert of wear resistant material mounted on a base of thermosetting plastic secured to the spreader bar or pipe with the insert being segmental and secured in a recess in the base by a resilient mounting material.

Another object of the invention is to provide a spreader shoe in accordance with the preceding object in which the segmental inserts are trapezoidal in configuration and provided with inclined end edges thereby eliminating straight end edges that would parallel the path of movement of the sheet or web of paper as it passes over the shoe thereby avoiding sharp edges or corners that could cut the sheet of paper.

A further object of the invention is to provide a spreader shoe in accordance with the preceding objects mounted on a spreader bar in a paper machine in which the inserts on the base are in the form of aluminum oxide ceramic segments to form a wear resistant strip throughout the length of the shoe and spreader bar with the base of the spreader shoe being secured to the spreader bar and the wear strip being received in a recess in the exterior periphery of the base and secured in place by silicone material to accommodate uneven thermal expansion due to the dissimilarity of materials used in constructing the wear strip and base.

Still another object of the invention is to provide a spreader shoe with a wear resistant insert mounted on a spreader bar in a paper machine to smooth the paper sheet or web which is relatively simple in construction, long lasting and dependable in operation and relatively inexpensive to manufacture, install and maintain.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
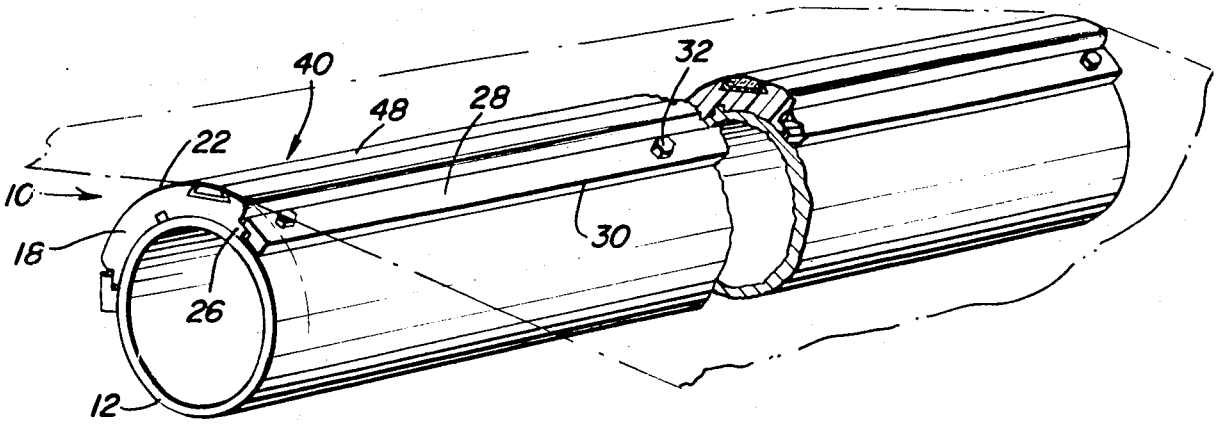
FIG. 1 is a perspective view of the spreader bar with the spreader shoe and wear resistant insert strip mounted thereon.
Figure 3:
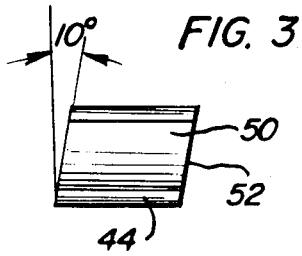
FIG. 3 is a top plan view of one of the segments of the wear resistant strip.

Referring now specifically to the drawings, the spreader shoe of the present invention is generally designated by numeral 10 and is mounted on a tubular spreader bar 12 which is of known construction and usually is bowed from end to end to smooth a paper sheet or web 14 passing thereover which is formed by a paper machine and which travels in the direction of the arrow 16 for winding on a takeup reel at the end of the paper machine.

The spreader shoe 10 of the present invention includes an elongated base 18 which has an arcuate inner edge 20 conforming with and engaging the exterior of the tubular spreader bar 12 and an arcuate outer edge 22 concentric with the inner edge 20 with both of the surfaces being concentric with the center of the tubular spreader bar 12. In one embodiment of mounting the base on the spreader bar 12, the base is provided with edge recesses 24 forming a flange 26 that is engaged by a flange 28 on a mounting and retaining strip 30 secured to the spreader bar 12 by threaded bolts 32 thus securely mounting the base 18 onto the spreader bar 12 with the base being keyed to the spreader bar 12 by a projection 34 on the spreader bar 12 received in a recess 36 in the inner surface of the base 18. The base 18 is constructed of a substantially rigid thermosetting plastic material formed by conventional molding techniques.

Figure 2:
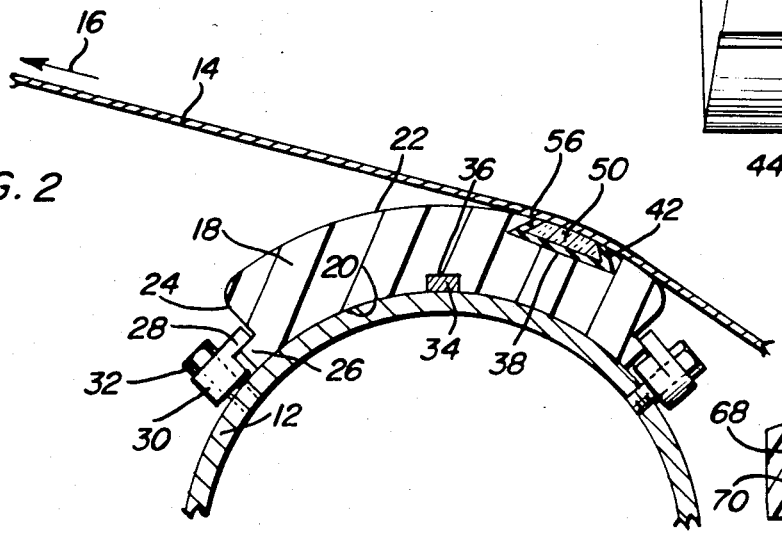
FIG. 2 is a transverse, sectional view, on an enlarged scale, illustrating the structure of the components of the present invention and their association with a paper web or sheet.
Figure 4:
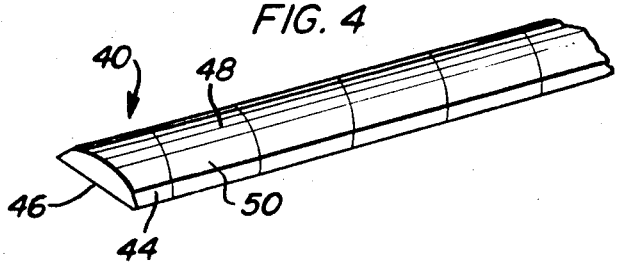
FIG. 4 is a fragmental perspective view of several of the segments assembled to form the wear resistant strip.

The outer periphery 22 of the base 18 is provided with a longitudinal recess 38 receiving a wear resistant strip generally designated by the numeral 40. As illustrated in FIG. 2, the sidewalls 42 of the recess 38 converge outwardly and the side edges 44 of the strip 40 correspondingly converge with the inner surface 46 of the strip 40 being substantially flat and straight and parallel to the bottom of the recess 38 as illustrated in FIG. 2. The exterior surface of the strip 40 is slightly arcuate at 48 to correspond with the curvature of the outer surface 22 of the base 18. The wear resistant strip 40 is constructed from a pluarlity of trapezoidal segments 50 each of which includes parallel inclined end edges 52 so that when a plurality of the segments 50 are assembled as illustrated in FIG. 4, the juncture line between adjacent segments is inclined in relation to the direction of movement of the paper web or sheet 14 thereby eliminating sharp end edges which might tend to cut the paper web or sheet 14.

The wear resistant strip 40 is mounted in the recess 38 by a layer of resilient silicone 56 which is interposed between the bottom of the strip 40 and the bottom of the recess 38 and between the sidewalls 42 of the recess and the side edges 44 of the strip 40.

The segments or inserts 50 are constructed of very hard and brittle aluminum oxide ceramic material whereas the base 18 is constructed of plastic material having a coefficient of thermal expansion substantially different from that of the wear resistant insert. Thus, the silicone interface 56 between the wear resistant strip segments 50 and the base 18 allows for movement between the two dissimilar materials and provides for and accommodates dimensional changes that occur during thermal expansion which is especially critical on a long machine in which the spreader bar and shoe can reach lengths of almost 400 inches.

The spreader shoe including the base 18 and the stip 40 of segmental ceramic inserts 50 is used in lieu of a conventional spreader bar that involves a tubular pipe that is bowed to a desired curvature. The pipe or spreader bar removes wrinkles and smooths the paper sheet or web as it is being wound onto the takeup reel at the end of the paper machine. The spreader bar or pipe is not constructed for wear resistance and must be replaced periodically which is both expensive and time consuming. In other machines, a bowed or curved roll that has rolling segments are provided for the paper sheet or web to pass over prior to it being wound onto the takeup reel in order to smooth the paper web or sheet. This type of curved roll is quite expensive and is also subject to considerable wear and replacement costs. The spreader shoe formed by the base 18 and the wear strip 40 forms an attachment for an existing spreader bar or tubular pipe which is bowed. The base 18 is constructed of a thermosetting plastic and the wear strip 40 is constructed of a plurality of aluminum oxide ceramic inserts 50 which are approximately two inches in length with the end edges 52 inclined approximately 10 degrees from being perpendicular to the longitudinal axis of the strip. The dimensional characteristics may vary and the aluminum oxide ceramic material resists wear when engaged by the sliding paper sheet with the wear strip 40 being oriented so that it engages the inner surface of the paper sheet 14 as it curves slightly around the spreader shoe 10 although the paper sheet is substantially tangential thereto.

The silicone material which forms an interface between the plastic base and the aluminum oxide ceramic wear strip 40 enables relative movement between the brittle aluminum oxide ceramic inserts and the relatively flexible plastic base and also provides for dimensional changes that occur during thermal expansion thereby providing an effective, long wearing spreader shoe but yet one which can be easily changed when desired.

Figure 5:
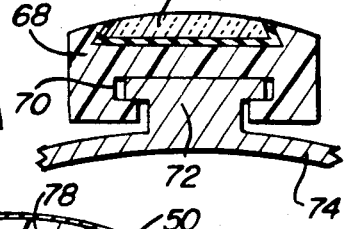
FIG. 5 is a fragmental sectional view illustrating another manner in which the spreader shoe may be secured to the spreader bar.

FIG. 5 illustrates a different type of mounting for the spreader shoe in which the base 68 is provided with a T-shaped recess 70 in its inner surface for sliding engagement with a corresponding projection 72 on the spreader bar 74 with a suitable set screw arrangement being provided to removably secure the base 68 on the projection 72 on the spreader bar 74.

Figure 6:
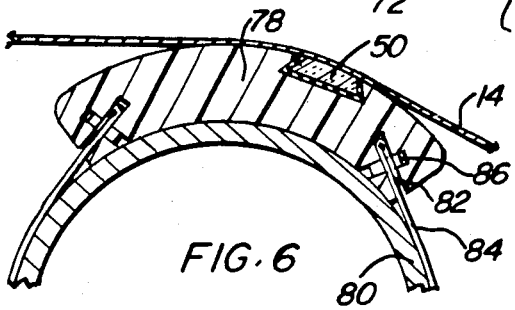
FIG. 6 is a fragmental sectional view illustrating another arrangement for mounting the spreader shoe on the spreader bar.

FIG. 6 illustrates another embodiment of base 78 mounted on a spreader bar or tubular pipe 80 having a smooth external surface with the base 78 including notches 82 receiving the ends of a retaining strap 84 retained in the notches 82 by a transverse pin 86. A clamping bolt may be oriented in the strap 84 opposite to the base 78 to tighten the strap 84 around the pipe 80 to rigidly and fixedly but adjustably secure the base 78 of the spreader shoe in position on the pipe. This structure enables the position of the shoe on the pipe to be adjusted without drilling and tapping holes as in the embodiment illustrated in FIGS. 1–4 and without having a specially shaped projection on the spreader bar as in FIG. 5. This also provides for rapid and quick mounting of the spreader shoe on the paper machine and adapts it to various types of existing paper machines and provides a secure attachment between the base 78 and the pipe 80 which forms a spreader bar.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A paper making machine having a spreader bar over which a paper web or sheet passes prior to being taken up on a takeup reel, a spreader shoe comprising an elongated base, means mounting said base longitudinally on the spreader bar, and an elongated wear resistant strip mounted on the outer surface of the base and extending throughout the length of the base and spreader bar, said wear resistant strip being constructed of a plurality of segments with each segment being trapezoidal and provided with inclined end faces to eliminate sharp edges engaging the paper sheet or web, said wear resistant strip being provided with a layer of silicone on the inner surface thereof interfacing with the base to enable relative movement and accommodate variation in thermal expansion of the wear resistant strip and base.

2. The structure as defined in claim 1 wherein said base is constructed of a thermosetting plastic, said wear strip segments being constructed of hard, brittle aluminum oxide ceramic material.

3. The structure as defined in claim 2 wherein said means mounting the base on the spreader bar includes a mounting strap encircling the spreader bar and having ends connected to the side edges of the base, means tightening the strap around the spreader bar.

4. The structure as defined in claim 2 wherein said means mounting the base on the spreader bar includes a longitudinal rib of generally T-shaped configurations on the spreader bar and a longitudinal groove of generally T-shaped configuration in the base for sliding interlocking connection therebetween.

5. The structure as defined in claim 2 wherein said means mounting the base on the spreader bar includes a longitudinally extending retaining strip bolted to the spreader bar, said retainer strip including a projecting flange oriented in overlying relation to an edge flange on the base for securing the base to the spreader bar.

6. In combination, a spreader bar for smoothing a paper sheet prior to it being wound onto a takeup reel, a wear resistant strip constructed of hard, brittle, wear resistant material and extending substantially throughout the length of said spreader bar and positioned for engagement with the paper sheet, said wear resistant strip being outwardly bowed longitudinally to smooth the paper sheet as it passes over the strip as it moves toward a takeup reel, and means mounting the wear resistant strip from the spreader bar to enable limited relative movement and replacement of the strip, said mounting means including an elongated base, means detachably securing the base to the spreader bar, and an interfacing layer of silicone between the wear resistant strip and base to enable relative movement and accommodate variation in thermal expansion of the wear resistant strip and base.

7. The combination of claim 6 wherein said wear resistant strip is constructed of a plurality of segments with each segment having end edges oriented in inclined relation to a radial plane perpendicular to the longitudinal axis of the strip thereby eliminating continuous sharp edges engaging the paper sheet or web along a continuous longitudinal line as would occur if the end edges of the segment were perpendicular to a radial plane perpendicular to the longitudinal axis of the strip.

* * * * *